US005284530A

United States Patent [19]

Azuma et al.

[11] Patent Number: 5,284,530

[45] Date of Patent: Feb. 8, 1994

[54] DUPLEX STAINLESS STEEL HAVING IMPROVED CORROSION RESISTANCE

[75] Inventors: Shigeki Azuma, Kobe; Takeo Kudo, Nishinomiya; Tadashi Fukuda, Amagasaki, all of Japan

[73] Assignee: Sumitomo Metal Industries, Ltd., Osaka, Japan

[21] Appl. No.: 953,095

[22] Filed: Sep. 29, 1992

[30] Foreign Application Priority Data

Sep. 30, 1991 [JP] Japan ..... 3-251858

[51] Int. Cl.[5] ..... C22C 38/44

[52] U.S. Cl. ..... 148/325; 148/327

[58] Field of Search ..... 148/325, 327

[56] References Cited

U.S. PATENT DOCUMENTS 4,604,887 8/1986 Ohtsubo et al. .

FOREIGN PATENT DOCUMENTS

2721998A1 12/1977 Fed. Rep. of Germany .
2228119 11/1974 France .
61-243149 10/1986 Japan .
62-56556 3/1987 Japan .
62-222043 9/1987 Japan .
68779 1/1974 Luxembourg .
2160221A 12/1985 United Kingdom .
2205857A 12/1988 United Kingdom .

*Primary Examiner*—Deborah Yee
*Attorney, Agent, or Firm*—Burns, Doane, Swecker & Mathis

[57] ABSTRACT

A high-Cr, high-Mo duplex stainless steel having excellent corrosion resistance as well as improved toughness and workability has a chemical composition which consists essentially, on a weight basis, of C: 0.03% or less, Si: 0.4% or less, Mn: 2.0% or less, Cr: 26.0–30.0%, Ni: 5.0–9.0%, Mo: 3.0 –4.5%, N: 0.10–0.35%, Al: 0.01–0.04%, optionally one or both of Cu and W in a total amount of 0.05–3.0% and/or one or more elements selected from Ca, B and Ce in a total amount of 0.001–0.01%, and a balance of Fe and incidental impurities, wherein the following inequality (1) is satisfied:

$$-1.5 \leqq PBI \leqq 1.5 \quad (1)$$

where $$PBI = 14 \times (Ni_{eq} - 0.61 \times CR_{eq} + 2.8)/(Cr_{eq} - 6)$$

$$Ni_{eq}(\%) = Ni + 0.5 \times Mn + 30 \times (C+N)\{+Cu\}$$

$$Cr_{eq}(\%) = Cr + 1.5 \times Si + Mo\{+0.5 \times W\}.$$

The steel is prepared by packing a gas-atomized powder of the steel composition into a metal container, sealing the metal container, and compacting and sintering the steel powder by applying hot working or a combination of hot working and cold working to the container.

10 Claims, 2 Drawing Sheets

DUPLEX STAINLESS STEEL HAVING IMPROVED CORROSION RESISTANCE

BACKGROUND OF THE INVENTION

The present invention relates to a duplex stainless steel having excellent corrosion resistance in a chloride-containing solution as well as improved toughness and workability, and a process for the production thereof.

Recent developments in the gas atomization process to prepare stainless steel powder and the powder compaction process to produce stainless steel products make it possible to produce those stainless steels which are difficult to manufacture by a conventional melting method which includes melting, casting and forging.

Duplex stainless steels are known to have high strength and excellent resistance to pitting corrosion, crevice corrosion, and stress-corrosion cracking, and they are nevertheless less expensive than austenitic stainless steels. Typical commercially-available duplex stainless steels contain 18 -26% Cr, 4 -8% Ni, and 1 -3% Mo. As the field of applications of duplex stainless steels is expanded, further improvements in their properties have been desired.

For example, it is possible to further improve the corrosion resistance of a duplex stainless steel by increasing the Cr and Mo contents thereof. However, when it is prepared by a conventional melting process, the formation of intermetallic compounds occurs inevitably, thereby causing a decrease in toughness of the steel.

Japanese Patent Applications Laid-Open Nos. 61-243149(1986) and 62-222043(1987) disclose the production of high-Cr, high-Mo duplex stainless steels by the powder metallurgy method, i.e., a combination of the above-described gas atomization and powder compaction processes, which eliminates embrittlement of the stainless steel products caused by precipitation of intermetallic compounds. The precipitation of intermetallic compounds during preparation of such stainless steels was thought to be unavoidable in a conventional melting process. In contrast, application of the powder metallurgy method makes it possible to realize an increase in the Cr and Mo contents of a duplex stainless steel, which is desired for such a steel, without precipitation of intermetallic compounds.

Japanese Patent Application Laid-Open No. 62-56556(1987) describes the preparation by the melting method of a high-Cr, high-Mo duplex stainless steel containing 23% -27% Cr and 3.5%-4.9% Mo by weight. However, the Cr content of suc virtually limited to 25% by weight or less in order to prevent the formation of chromium nitride and intermetallic compounds. Therefore, it is not ensured that the steel has fully improved corrosion resistance.

The production of stainless steel powder by the gas atomization process is normally conducted either (1) by merely remelting a previously-prepared master alloy in an inductionheating furnace to form a molten alloy, which is then forced through a small orifice by a rapid stream of an inert gas for atomization (remelting method), or (2) by melting individual alloying metals together in a similar furnace in which the proportions of the alloying metals are adjusted so as to form a molten alloy having the desired alloy composition, followed by atomization in the above manner (melting method).

In the case of a high-Cr, high-Mo duplex stainless steel, it is difficult to previously prepare a master alloy for remelting since it is brittle and difficult to work by forging or other means into a prescribed shape of a master alloy. Therefore, the above-described method (2) is solely employed in the preparation of a powder of such a duplex stainless steel.

According to this method, however, refining treatment such as desulfurization or deoxidation can normally not be performed on the resulting molten alloy during melting in an inductionheating furnace. Therefore, particularly in the preparation of a high-Cr, high-Mo stainless steel powder, this method tends to give a steel powder product having an increased oxygen content due to a high susceptibility of chromium to oxidation. As a result, the resulting powder has a decreased hot workability and therefore it is difficult to compact into a desired shape by means of hot working. In addition, the amount of inclusions formed in the resulting steel is so increased that the cleanness and hence the corrosion resistance of the steel are degraded. In order to produce a steel powder having a decreased oxygen content, it is necessary not only to control the surrounding atmosphere but also to use pure alloying metals as raw materials. However, unlike a laboratory experiment, it is difficult for industrial-scale production of stainless steel powders to meet such conditions.

Furthermore, although the use of the powder metallurgy method in the production of a high-Cr, high-Mo duplex stainless steel can produce a compacted body without embrittlement due to precipitation of intermetallic compounds, the subsequent cooling of the compacted body is accompanied by precipitation of intermetallic compounds. Therefore, in this method as well, the product is brittle and is difficult to transport and subject to cold working and machining.

SUMMARY OF THE INVENTION

It is an object of the present invention to provide a duplex stainless steel having excellent corrosion resistance as well as improved toughness and workability.

Another object of the invention is to provide a high-Cr, high-Mo duplex stainless steel produced by the powder metallurgy method which is free from not only degradation of the steel in workability and corrosion resistance due to an increase in oxygen content of the steel during the preparation of a steel powder but also embrittlement of the steel due to precipitation of intermetallic compounds during cooling after the powder is compacted and hot-worked.

A further object of the invention is to provide a process for producing such a duplex stainless steel.

In one aspect, the present invention provides a duplex stainless steel having excellent corrosion resistance as well as improved toughness and workability, the steel having a chemical composition which consists essentially, on a weight basis, of:

| | |
|---|---|
| C: 0.03% or less, | Si: 0.4% or less, |
| Mn: 2.0% or less, | Cr: 26.0–30.0%, |
| Ni: 5.0–9.0%, | Mo: 3.0–4.5%, |
| N: 0.10–0.35%, | Al: 0.01–0.04%, |

optionally one or both of Cu and W in a total amount of 0.05 -3.0% and/or one or more elements selected from the group consisting of Ca, B and Ce in a total amount of 0.001 -0.01%, and a balance of Fe and incidental impurities in which the P, S, and oxygen contents as impurities are P: 0.03% or less, S: 0.004% or less, and oxygen: 0.015% or less, the composition satisfying the following inequality (1):

$$-1.5 \leqq PBI \leqq 1.5 \quad (1)$$

where $PBI = 14 \times (Ni_{eq} - 0.61 \times Cr_{eq} + 2.8)/(Cr_{eq} - 6)$ $$Ni_{eq}(\%) = Ni + 0.5 \times Mn + 30 \times (C + N)\{+Cu\}$$

$$Cr_{eq}(\%) = Cr + 1.5 \times Si + Mo\{+0.5 \times W\}.$$

In another aspect, the present invention provides a process for producing a duplex stainless steel having excellent corrosion resistance and improved toughness and workability, comprising preparing a steel powder having a chemical composition as defined above, packing the steel powder into a metal container, sealing the metal container, and compacting and sintering the steel powder by applying hot working or a combination of hot working and cold working to the container.

DESCRIPTION OF THE INVENTION

Figure 1:
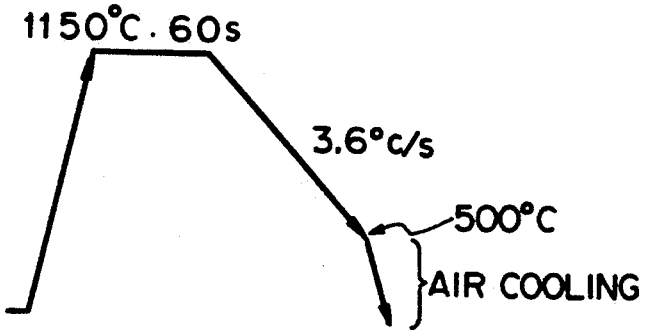
FIG. 1 shows a heat treatment pattern applied to steels in order to examine embrittlement due to precipitation of intermetallic compounds.

The present inventors investigated the effects of minor alloying elements present in high-Cr, high-Mo duplex stainless steels on the oxygen content of a gas-atomized powder and the precipitation of intermetallic compounds during cooling of compacted bodies.

The oxygen content of a gas-atomized steel powder depends on the concentrations of deoxidizing elements, Si and Al, in the molten steel, i.e., Si and Al contents of the steel. Thus, it is expected that the oxygen content of a gas-atomized powder can be decreased by increasing the contents of these elements. However, an increase in Si content may accelerate precipitation of intermetallic compounds, which embrittle the steel, and an increase in Al content leads to precipitation of aluminum nitride since a duplex stainless steel contains a relatively large amount of nitrogen. The formation of aluminum nitride is not desirable since it not only degrades the cleanness of the steel but also decreases the amount of nitrogen dissolved in the steel as a solid solution, which is undesirable because nitrogen contributes to improvement in corrosion resistance. Therefore, in the prior-art high-Cr, high-Mo duplex stainless steel, Al is not added, or if added, the Al content is limited to less than 0.01% by weight.

The precipitation of intermetallic compounds during cooling subsequent to compacting by hot working occurs due to the fact that cooling proceeds slowly. The elements which primarily participate in the precipitation of intermetallic compounds during such slow cooling are Cr, Mo, and Si. Therefore, it is expected that a decrease in the contents of these elements will be effective for suppressing the precipitation of intermetallic compounds. However, it is not desirable to decrease the Cr and Mo contents since these elements are essential for providing the steel with the requisite corrosion resistance. A decrease in the Si content is also thought to be undesirable in view of the above-described effect of Si on a decrease in oxygen content.

Noting the fact that both the oxygen content and precipitation of intermetallic compounds are influenced by the Si content, the present inventors studied which is more influenced by the Si content. As a result, it was found that the effect of a decrease in the Si content on suppression of precipitation of intermetallic compounds is greater. It was also found that the adverse effect of addition of Al to compensate for a decreased Si content is slight compared to the favorable effect attained by a decrease in the Si content in the powder metallurgy method.

On the basis of these findings, the present inventors further studied the influences of variations in the Si and Al contents of high-Cr, high-Mo duplex stainless steels on the oxygen content, corrosion resistance, and embrittlement due to precipitation of intermetallic compounds and found the following: (1) the Si content can be significantly decreased if Al is added as a deoxidizer in place of Si, which is the deoxidizer predominantly used in such steels, thereby making it possible to prevent the precipitation of intermetallic compounds during cooling after compacting; (2) the precipitation of aluminum nitride due to addition of Al can be substantially prevented if the Al content is limited to a proper range; and (3) these effects synergistically result in very effective prevention of the formation of intermetallic compounds during slow cooling.

The reasons for restricting the steel composition as above will now be described. In the following description, all percents are by weight unless otherwise indicated.

Carbon (C)

Carbon does not affect the steel properties as long as it is present as solid solution in the steel. However, the presence of too much carbon should be avoided since carbon precipitates mainly as Cr carbide in welds, thereby causing a deterioration in corrosion resistance and toughness in welds. Therefore, the carbon content is 0.03% or less and preferably 0.02% or less.

Silicon (Si)

Silicon is essential as a deoxidizer but it has an adverse effect that it accelerates embrittlement due to precipitation of intermetallic compounds during slow cooling, as described above. In view of this effect of Si, the Si content is restricted to 0.4% or less, since the addition of Si in excess of 0.4% causes embrittlement due to precipitation of intermetallic compounds during slow cooling which takes place after compacting. Preferably, the Si content is at most 0.3%.

Manganese (Mn)

Manganese is essential as a deoxidizer. Since the addition of Mn in an excessive proportion causes the formation of MnS, which deteriorates the corrosion resistance of the steel, the Mn content is 2.0% or less.

Chromium (Cr)

The higher the Cr content, the better the corrosion resistance. However, the addition of Cr in excess of 30.0% not only negates the economic merits of duplex stainless steels but also makes it difficult to produce the steel without embrittlement due to precipitation of intermetallic compounds, even in the process according to the present invention. Furthermore, the toughness of welds is significantly degraded. On the other hand, duplex stainless steels containing less than 26.0% Cr can be produced by the conventional melting method and their corrosion resistance remains at the same level as conventional 25%-Cr duplex stainless steels. Therefore, the Cr content is 26.0 -30.0% and preferably 27.5 -29.0%.

Nickel (Ni)

Nickel is effective for improving corrosion resistance and has a high austenite-forming ability. Therefore, the addition of Ni in an appropriate amount is necessary to assure that the resulting steel has a duplex structure. An Ni content of less than 5.0% is not sufficient to obtain good duplex structure and properties, while an Ni content of more than 9.0% causes embrittlement due to precipitation of intermetallic compounds in welds, thereby degrading the toughness of the steel. Therefore, the Ni content is 5.0 -9.0% and preferably 6.0 -8.0%.

Molybdenum (Mo)

Like Ni, molybdenum is an element which plays an important role in improvement in corrosion resistance. The addition of Mo in an amount of at least 3.0% is required to assure that the resulting steel has substantially improved corrosion resistance. The corrosion resistance is improved with increasing Mo content. However, a steel containing more than 4.5% Mo is difficult to produce without embrittlement due to precipitation of intermetallic compounds even in the process according to the present invention. Therefore, the Mo content is 3.0 -4.5% and preferably 3.5 -4.5%.

Nitrogen (N)

Like Ni, nitrogen is an effective austenite-former and serves to improve corrosion resistance. In the present invention, N is positively added in order to accelerate the formation of austenitic phases at high temperatures and improve the corrosion resistance in welds. These effects cannot be attained significantly with an N content of less than 0.10%. The addition of more than 0.35% N is excessive and may cause the precipitation of chromium nitride in welds, leading to a degradation in corrosion resistance. Therefore, the N content is 0.10 -0.35%. Preferably, it is 0.25 -0.35% for further improvement in resistance to pitting corrosion.

Aluminum (Al)

As described above, while aluminum serves as a deoxidizer, the addition of an excess amount of aluminum causes precipitation of aluminum nitride, which is undesirable for the steel structure and leads to a loss of corrosion resistance due to a decrease in the amount of nitrogen dissolved as a solid solution.

An Al content of 0.01 -0.04% which is higher than that in a conventional duplex stainless steels is selected in the present invention in combination with a lower Si content. When the Al content is less than 0.01%, the oxygen content is undesirably increased, resulting in a degradation in properties. An Al content of more than 0.04% may cause precipitation of aluminum nitride. Preferably, the Al content is 0.02 -0.03%.

Phosphorus (P), Sulfur (S), Oxygen (O)

These elements are incidental impurities. The P content is restricted to 0.03% or less since the high temperature weld cracking properties are degraded with a P content of more than 0.03%. Sulfur forms MnS in the steel and adversely affects the hot workability. These phenomena become significant at an S content of more than 0.004%, so the S content is restricted to 0.004% or less. The oxygen content is restricted to 0.015% or less since the presence of oxygen in excess of 0.015% significantly decreases the cleanness of the steel due to the formation of oxide inclusions. This level of oxygen content can be industrially achieved by the powder metallurgy method in spite of an increase in oxygen content during melting. Preferably, the contents of S and O should be 0.002% or less and 0.010% or less, respectively, in order to ensure that the steel has improved hot workability.

Copper (Cu), Tungsten (W)

Copper and tungsten are optional alloying elements, which have an effect of improving the corrosion resistance in nonoxidizing acids. This effect is appreciable when the total amount of these elements is 0.05% or more and tends to saturate when the total amount is increased to 3.0% or more. Therefore, one or both of Cu and W may be added in a total amount of 0.05 -3.0%, if necessary.

Calcium (Ca), Boron (B), Cerium (Ce)

Calcium, boron, and cerium are also optional alloying elements which serve to improve the hot workability of the steel. Such improvement cannot be attained when the total amount of these elements is less than 0.001%. The addition of these elements in a total amount exceeding 0.01% may cause a loss of corrosion resistance. Therefore, one or more of Ca, B, and Ce may be added in a total amount of 0.001 -0.01%, if necessary.

In order to assure that the proportion of austenitic phases relative to the sum of austenitic phases and ferritic phases is within a proper range of 40 -60 vol%, the contents of C, N, Cr, Ni, Mo, Si, Mn, Cu and W in the duplex stainless steel of the present invention should satisfy the following inequality (1):

$$-1.5 \leqq PBI \leqq 1.5 \quad (1)$$

where $PBI = 14 \times (Ni_{eq} - 0.61 \times Cr_{eq} + 2.8)/(Cr_{eq} - 6)$ $$Ni_{eq}(\%) = Ni + 0.5 \times Mn + 30 \times (C+N)\{+Cu\}$$

$$Cr_{eq}(\%) = Cr + 1.5 \times Si + Mo\ \{+0.5 \times W\}.$$

For a Cu- and W-free steel composition, the $Ni_{eq}$ and $Cr_{eq}$ are calculated by the following formulas:

$$Ni_{eq}(\%) = Ni + 0.5 \times Mn + 30 \times (C+N)$$

$$Cr_{eq}(\%) = Cr + 1.5 \times Si + Mo.$$

When the steel composition contains Cu and/or W, the $Ni_{eq}$ and $Cr_{eq}$ are calculated by the following formulas:

$$Ni_{eq}(\%) = Ni + 0.5 \times Mn + 30 \times (C+N) + Cu$$

$$Cr_{eq}(\%) = Cr + 1.5 \times Si + Mo + 0.5 \times W.$$

The proportion of ferritic phases is excessive when the value for PBI is less than −1.5, while the proportion of austenitic phases is excessive when the value for PBI is more than 1.5. The presence of such an excessive amount of austenitic or ferritic phases results in a decrease in corrosion resistance and toughness. Preferably the value for PBI is between −1 and 1.

The duplex stainless steel according to the present invention can be produced by the powder metallurgy method. Thus, a molten alloy composition having a desired chemical composition is prepared by melting a combination of alloying metals adjusted so as to give the desired composition. Alternatively, a low-Cr, low-Mo duplex stainless steel which can be successfully produced by the conventional melting method may be used as a master alloy for remelting. In this case, the molten alloy composition can be prepared by remelting the master alloy to which insufficient alloying elements such as Cr and Mo have been added.

The molten alloy composition is then subjected to atomization in a conventional manner to prepare a powder of the steel. The atomization is preferably performed by gas atomization since contamination of the resulting steel powder with oxygen and carbon is minimized, thereby making it possible to maintain the cleanness of the steel, and it is easy to add nitrogen to the steel.

The resulting steel powder is packed into a metal container, which is then sealed. The metal container in which the steel powder is contained is subjected to hot working or a combination of hot working and cold working for compaction and sintering of the powder to give a duplex stainless steel product, e.g., in the form of sheet, plate, rod, bar, wire, seamless pipe or tube, shaped articles, or the like. Any working process known in the art may be employed for this purpose.

Specific examples of hot or cold working methods which can be employed include hot isostatic pressing, cold isostatic pressing, hot extrusion, hot forging, hot rolling, cold drawing, and cold rolling. Specific examples of a combination of hot working and cold working include (1) hot isostatic pressing and hot extrusion, (2) hot isostatic pressing and hot rolling, (3) cold isostatic pressing and hot extrusion, and (4) cold isostatic pressing and hot forging and hot rolling, each followed by cold rolling.

The resulting stainless steel product should have a density higher than that of a sintered body prepared from the same powder by mere sintering. As long as such a dense body is obtained, any hot working or any combination of hot working and cold working may be employed in the present invention.

The stainless steel product may be subjected to appropriate heat treatment such as solid solution heat treatment, if necessary. The solid solution heat treatment can be performed in a conventional manner, for example, by heating at 1000 - 200° C. and preferably 1050 -1150° C. followed by water cooling.

Although less expensive than austenitic stainless steels, the high-Cr, high-Mo duplex stainless steel according to the present invention has excellent corrosion resistance as well as improved toughness and workability. Therefore, it finds many industrial applications, for example, as tubing and piping, joints, and structural and mechanical parts for use in a chloride-containing environment as well as heat-transfer tubes for heat exchangers.

The following examples are presented to further illustrate the present invention. These examples are to be considered in all respects as illustrative and not restrictive.

EXAMPLE 1

Various steel powders having an average particle diameter of 150 -500 μm were prepared by argon gas atomization using individual alloying metals as raw materials for melting. Each steel powder was packed in a cylindrical capsule-like container made of mild steel which measured 80 mm in diameter and 200 mm in height. The container was evacuated at ambient temperature and compacted by cold isostatic pressing. The container was then heated to 1200° C. and hot extruded so as to form a bar 25 mm in diameter. The bar was hot-rolled into a 7 mm-thick plate and the resulting plate was finally subjected to solid solution heat treatment which comprised heating for 30 minutes at 1100° C. followed by water cooling.

The resulting plates were analyzed for chemical compositions and their properties were tested as follows.

The resistance to pitting corrosion in chloride-containing environments was evaluated in terms of the pitting potential measured in artificial sea water (ASTM-D1141-52) of pH 8 having the composition shown in Table 3 at 100° C.

The toughness was evaluated by the Charpy impact strength measured using 5 mm-thick V-notched test pieces according to JIS-Z2202 at 0° C.

The embrittlement due to precipitation of intermetallic compounds was evaluated by the Charpy impact strength measured as above after the test pieces had been subjected to heat treatment having the pattern shown in FIG. 1, which simulated slow cooling encountered at the end of hot working and which gave conditions under which the precipitation of intermetallic compounds was accelerated.

The corrosion resistance in non-oxidizing acids was evaluated by the corrosion rate measured in an immersion test in a 2% hydrochloric acid solution at 80° C., while the hot workability was evaluated by the value for reduction of area measured in a tensile test at 1100° C.

The chemical compositions and test results of the duplex stainless steels prepared in this example are summarized in Tables 1 and 2, respectively.

TABLE 1

| | STEEL COMPOSITION (% by weight) | | | | | | | | | | | | | | | |
|---|---|---|---|---|---|---|---|---|---|---|---|---|---|---|---|---|
| No. | C | Si | Mn | P | S | Ni | Cr | Mo | sol.Al | N | O | Cu | W | Ca, Ce, B | PBI | |
| 1 | 0.012 | 0.37 | 1.22 | 0.013 | 0.0008 | 6.84 | 27.6 | 3.6 | 0.019 | 0.25 | 0.006 | — | — | — | −0.69 | THIS |
| 2 | 0.018 | 0.18 | 0.92 | 0.015 | 0.0009 | 7.21 | 28.5 | 3.8 | 0.031 | 0.29 | 0.008 | — | — | — | −0.08 | INVEN- |
| 3 | 0.009 | 0.26 | 1.31 | 0.009 | 0.0014 | 6.93 | 27.9 | 3.6 | 0.015 | 0.29 | 0.006 | 0.67 | — | — | 0.31 | TION |
| 4 | 0.021 | 0.28 | 1.41 | 0.024 | 0.0009 | 7.32 | 27.4 | 3.9 | 0.024 | 0.24 | 0.009 | — | 0.65 | — | −0.48 | |
| 5 | 0.013 | 0.32 | 1.22 | 0.018 | 0.0011 | 6.51 | 28.2 | 3.3 | 0.032 | 0.32 | 0.007 | 0.43 | 1.2 | — | 0.25 | |
| 6 | 0.022 | 0.29 | 1.12 | 0.018 | 0.0007 | 7.32 | 28.2 | 3.8 | 0.016 | 0.26 | 0.005 | — | — | 0.005 Ca | −0.34 | |
| 7 | 0.011 | 0.33 | 1.11 | 0.021 | 0.0009 | 7.14 | 27.5 | 4.1 | 0.022 | 0.33 | 0.006 | — | — | 0.006 Ce | 0.62 | |
| 8 | 0.015 | 0.32 | 1.42 | 0.012 | 0.0012 | 6.82 | 28.4 | 3.6 | 0.023 | 0.27 | 0.004 | — | — | 0.004 B | −0.49 | |
| 9 | 0.009 | 0.24 | 1.16 | 0.016 | 0.0008 | 6.78 | 27.6 | 3.8 | 0.031 | 0.28 | 0.007 | — | — | 0.004 Ca + | −0.30 | |

TABLE 1-continued

STEEL COMPOSITION

| No. | C | Si | Mn | P | S | Ni | Cr | Mo | sol.Al | N | O | Cu | W | Ca, Ce, B | (% by weight) PBI | |
|---|---|---|---|---|---|---|---|---|---|---|---|---|---|---|---|---|
| 10 | 0.011 | 0.36 | 1.43 | 0.012 | 0.0011 | 7.12 | 27.6 | 3.6 | 0.027 | 0.34 | 0.004 | — | — | 0.003 B 0.002 Ca + 0.003 Ce + 0.004 B | 0.98 | |
| 11 | 0.009 | 0.34 | 1.06 | 0.023 | 0.0009 | 6.92 | 28.1 | 3.6 | 0.021 | 0.32 | 0.007 | 0.36 | 1.02 | 0.005 Ca | 0.27 | |
| 12 | 0.013 | 0.29 | 1.26 | 0.019 | 0.0008 | 6.87 | 27.6 | 3.9 | 0.029 | 0.29 | 0.004 | 0.51 | 0.69 | 0.004 Ca + 0.004 B | 0.11 | |
| 13 | 0.013 | 0.49* | 1.64 | 0.019 | 0.0009 | 7.36 | 28.2 | 3.9 | 0.024 | 0.31 | 0.008 | — | — | — | 0.33 | COM- |
| 14 | 0.012 | 0.76* | 1.68 | 0.021 | 0.0008 | 7.41 | 28.1 | 3.6 | 0.031 | 0.27 | 0.004 | — | — | — | −0.27 | PAR- |
| 15 | 0.021 | 0.36 | 1.02 | 0.018 | 0.0007 | 6.96 | 27.6 | 3.5 | 0.006* | 0.31 | 0.023 | — | — | — | 0.49 | ATIVE |
| 16 | 0.008 | 0.32 | 1.36 | 0.013 | 0.0012 | 7.21 | 27.8 | 3.7 | 0.046* | 0.33 | 0.004 | — | — | — | 0.71 | |
| 17 | 0.024 | 0.21 | 1.69 | 0.011 | 0.0007 | 7.36 | 27.1 | 3.4 | 0.023 | 0.34 | 0.006 | — | — | — | 1.76* | |
| 18 | 0.009 | 0.36 | 1.23 | 0.016 | 0.0011 | 6.74 | 29.6 | 3.9 | 0.031 | 0.21 | 0.009 | — | — | — | −2.02* | |

(Note)
*outside the range defined herein.

TABLE 2

TEST RESULTS

| No. | Pitting Potential (Vvs.SCE) | Impact Strength ($MJ/m^2$) | Impact Strength after Slow Cooling ($MJ/m^2$) | Corrosion Rate in HCl ($g/m^2/hr$) | Reduction of Area in Hot Working (%) | |
|---|---|---|---|---|---|---|
| 1 | 0.86 | 1.6 | 1.6 | 4.5 | 70 | THIS |
| 2 | 0.92 | 1.8 | 1.6 | 5.8 | 72 | INVENTION |
| 3 | 0.84 | 1.5 | 1.6 | 2.2 | 74 | |
| 4 | 0.96 | 1.6 | 1.5 | 2.8 | 72 | |
| 5 | >1.0 | 1.7 | 1.5 | 0.8 | 72 | |
| 6 | 0.88 | 1.7 | 1.6 | 5.8 | 79 | |
| 7 | >1.0 | 1.4 | 1.5 | 6.2 | 82 | |
| 8 | 0.92 | 1.7 | 1.6 | 5.6 | 81 | |
| 9 | 0.82 | 1.6 | 1.5 | 5.4 | 78 | |
| 10 | 0.82 | 1.6 | 1.4 | 5.8 | 82 | |
| 11 | >1.0 | 1.5 | 1.5 | 1.4 | 79 | |
| 12 | >1.0 | 1.6 | 1.5 | 2.2 | 81 | |
| 13 | 0.86 | 1.7 | 0.9 | 6.2 | 71 | COMPARATIVE |
| 14 | 0.92 | 1.6 | 0.6 | 5.8 | 73 | |
| 15 | 0.62 | 1.0 | 0.9 | 12.4 | 64 | |
| 16 | 0.54 | 1.2 | 1.1 | 8.6 | 74 | |
| 17 | 0.74 | 1.7 | 1.2 | 13.2 | 68 | |
| 18 | 0.82 | 0.9 | 0.7 | 14.4 | 76 | |

TABLE 3

COMPOSITION OF ARTIFICIAL SEA WATER

| Ion Species | | 4 ppm |
|---|---|---|
| Chloride | $Cl^-$ | 18980.0 |
| Sulfate | $SO_4^{2-}$ | 2649.0 |
| Bicarbonate | $HCO_3^-$ | 139.7 |
| Bromide | $Br^-$ | 64.6 |
| Fluoride | $F^-$ | 1.3 |
| Boric Acid | $H_3BO_3$ | 26.0 |
| Sodium | $Na^+$ | 10556.1 |
| Magnesium | $Mg^{2+}$ | 1272.0 |
| Calcium | $Ca^{2+}$ | 400.1 |
| Potassium | $K^+$ | 380.1 |
| Strontium | $Sr^{2+}$ | 13.3 |

All the steels according to the present invention (Steels Nos. 1 to 12) had good resistance to pitting corrosion and good toughness after slow cooling. Furthermore, those steels additionally containing Cu and/or W (Steels Nos. 3 -5, 11, and 12) exhibited improved corrosion resistance in non-oxidizing acids, while those steels additionally containing Ca, B, and/or Ce (Steels Nos. 6 -12) exhibited improved hot workability. In contrast, any of the comparative steels having an Si or Al content outside the range defined herein (Steels Nos, 13 -16) and those having a PBI value outside the range defined herein (Steels Nos. 17 and 18) could not simultaneously exhibit good toughness after slow cooling and good resistance to pitting corrosion.

EXAMPLE 2

The effects of Si and Al contents on corrosion resistance and embrittlement due to precipitation of intermetallic compounds were tested on duplex stainless steels having the same composition as Steel No. 1 in Example 1 except that the Al and Si contents were varied. The testing procedures were the same as in Example 1 and each test was repeated three times.

Figure 2:
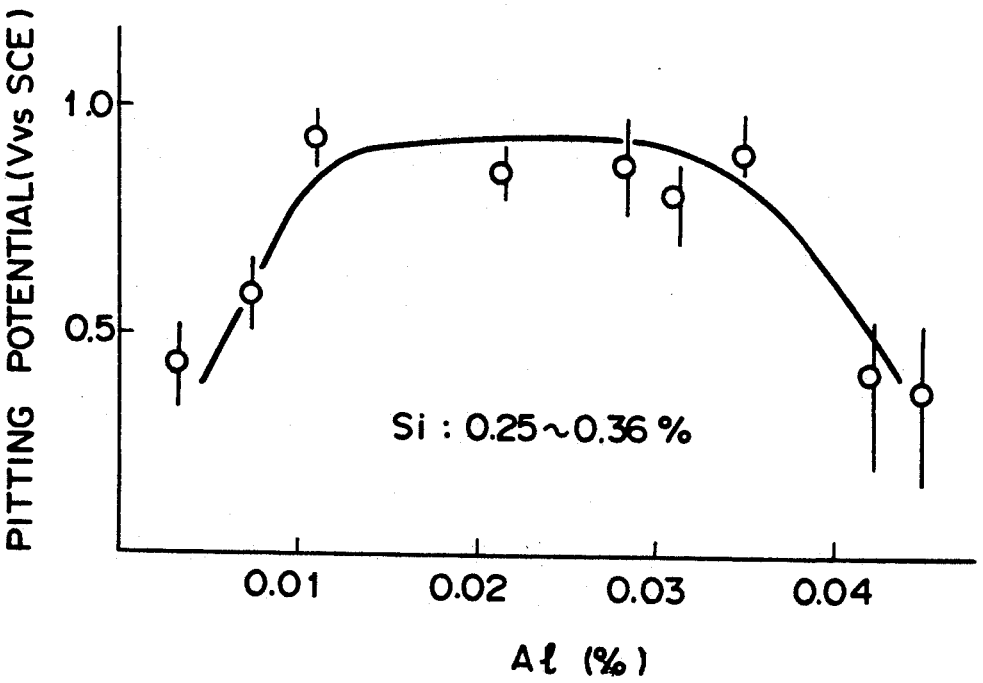
FIGS. 2 and 3 are graphs showing the results of examples.
Figure 3:
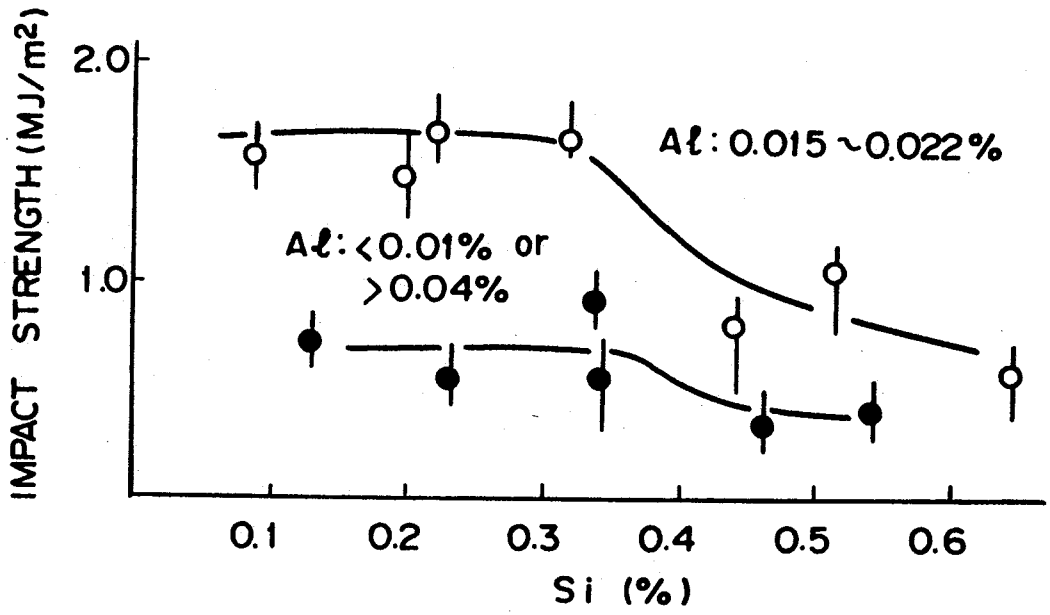

The results are shown in FIG. 2 (resistance to pitting corrosion) and FIG. 3 (toughness after slow cooling), in which the dots indicate the median values while the vertical lines indicate the maximum and minimum values, i.e., fluctuations. The minimum values fluctuated greatly when the Al or Si content was outside the range defined herein.

As can be seen from the results in these figures, the addition of Al in an amount of 0.01 -0.04% and a concomitant reduction in Si content to 0.4% or less had an unexpected synergistic effect on prevention of embrittlement due to intermetallic compounds and improvement in corrosion resistance.

It will be appreciated by those skilled in the art that numerous variations and modifications may be made to the invention as described above without departing from the spirit or scope of the invention as broadly described.

What is claimed is:

1. A duplex stainless steel having excellent corrosion resistance as well as improved toughness and workability, said steel having a chemical composition which consists essentially, on a weight basis, of:

| | |
|---|---|
| C: 0.03% or less, | Si: 0.4% or less, |
| Mn: 2.0% or less, | Cr: 26.0–30.0%, |
| Ni: 5.0–9.0%, | Mo: 3.0–4.5%, |
| N: 0.25–0.35%, | Al: 0.01–0.04%, |

one or both of Cu and W in a total amount of 0 –3.0%, one or more elements selected from the group consisting of Ca, B and Ce in a total amount of 0 –0.01%, and a balance of Fe and incidental impurities in which the P, S, and oxygen contents as impurities are P: 0.03% or less, S: 0.004% or less, and oxygen: 0.015% or less, said composition satisfying the following inequality (1):

$$-1.5 \leqq PBI \leqq 1.5 \quad (1)$$

where $PBI = 14 \times (Ni_{eq} - 0.61 \times Cr_{eq} + 2.8)/(Cr_{eq} - 6)$ $$Ni_{eq}(\%) = Ni + 0.5 \times Mn + 30 \times (C + N)\{+Cu\}$$

$$Cr_{eq}(\%) = Cr + 1.5 \times Si + Mo\{+0.5 \times W\}.$$

2. The duplex stainless steel of claim 1, which contains one or both of Cu and W in a total amount of 0.05 –3.0%.

3. The duplex stainless steel of claim 1, which contains one or more elements selected from Ca, B and Ce in a total amount of 0.001 –0.01%.

4. The duplex stainless steel of claim 1, which contains one or both of Cu and W in a total amount of 0.05 –3.0% and one or more elements selected from Ca, B and Ce in a total amount of 0.001 –0.01%.

5. The duplex stainless steel of claim 1, wherein the Si content is 0.3% or less.

6. The duplex stainless steel of claim 1, wherein the Cr content is 27.5 –29.0%.

7. The duplex stainless steel of claim 1, wherein the Ni content is 6.0 –8.0%.

8. The duplex stainless steel of claim 1, wherein the Mo content is 3.5 –4.5%.

9. The duplex stainless steel of claim 1, wherein the Al content is 0.02 –0.03%.

10. The duplex stainless steel of claim 1, wherein the value of PBI is between −1 and 1.

* * * * *